US011014362B2

(12) United States Patent
Ueno et al.

(10) Patent No.: US 11,014,362 B2
(45) Date of Patent: May 25, 2021

(54) WIPE UNIT AND INK JET RECORDING APPARATUS INCLUDING THE SAME

(71) Applicant: KYOCERA Document Solutions Inc., Osaka (JP)

(72) Inventors: Daijiro Ueno, Osaka (JP); Yuzo Onishi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/671,898

(22) Filed: Nov. 1, 2019

(65) Prior Publication Data

US 2020/0139712 A1 May 7, 2020

(30) Foreign Application Priority Data

Nov. 6, 2018 (JP) ..... JP2018-208810

(51) Int. Cl.
*B41J 2/165* (2006.01)

(52) U.S. Cl.
CPC ..... *B41J 2/16535* (2013.01)

(58) Field of Classification Search
CPC ... B41J 2/1721; B41J 2/16588; B41J 2/16547
See application file for complete search history.

(56) References Cited

U.S. PATENT DOCUMENTS

2008/0291239 A1* 11/2008 Kita ..... B41J 2/16544 347/33

FOREIGN PATENT DOCUMENTS

JP 2014-65261 A 4/2014

* cited by examiner

*Primary Examiner* — Lam S Nguyen
(74) *Attorney, Agent, or Firm* — Stein IP, LLC

(57) ABSTRACT

A wipe unit, including one or more wipers, a wiper carriage, a collection tray, and an ink receiving member, cleans a recording head having an ink ejection surface in which an ink ejection port for ejecting ink onto a recording medium is opened. The one or more wipers wipe off ink on the ink ejection surface. The wiper carriage is moved along a wiping direction while holding the wiper. The collection tray, having a tray surface and placed below the wiper, collects ink wiped off by the wiper. The ink receiving member, which is recessed-shaped and provided in the wiper carriage, receives ink dropping from a wiper that is placed furthest downstream in the wiping direction among the one or more wipers, and moreover the ink receiving member lets the ink drop onto the tray surface.

7 Claims, 14 Drawing Sheets

WIPE UNIT AND INK JET RECORDING APPARATUS INCLUDING THE SAME

INCORPORATION BY REFERENCE

This application is based upon and claims the benefit of priority from the corresponding Japanese Patent Application No. 2018/208810 filed on Nov. 6, 2018, the entire contents of which are incorporated herein by reference.

BACKGROUND

The present disclosure relates to a wipe unit, as well as an ink jet recording apparatus including the wipe unit, for cleaning recording heads which eject ink onto a recording medium such as a paper sheet.

As a recording apparatus such as facsimiles, copiers and printers, ink jet recording apparatuses in which ink is ejected to form images are widely used by virtue of their high-definition image-forming capability.

Conventionally, for ink jet recording apparatuses, it is common practice to execute a recovery process in which ink thickened within ink ejection ports is forcedly pushed out through the ink ejection ports and wiped off by wiper. For this purpose, an ink jet recording apparatus is equipped with a recording head for ejecting ink onto a paper sheet (recording medium), and a wipe unit for cleaning the recording head.

The wipe unit includes a wiper for wiping off forcedly pushed-out ink, a wiper carriage which is moved along a wiping direction while holding the wiper, and a collection tray placed below the wiper and having a tray surface for collecting ink that has been wiped off by the wiper.

In addition, there has been disclosed a prior-art ink jet recording apparatus in which a recording head recovery process is executed by a wipe unit.

SUMMARY

A wipe unit according to one aspect of the present disclosure, including one or more wipers, a wiper carriage, a collection tray, and an ink receiving member, cleans a recording heed having an ink ejection surface in which an ink ejection port for ejecting ink onto a recording medium is opened. The one or more wipers wipe off ink on the ink ejection surface. The wiper carriage is moved along a wiping direction while holding the wiper. The collection tray, having a tray surface and placed below the wiper, collects ink wiped off by the wiper. The ink receiving member, which is recessed-shaped and provided in the wiper carriage, receives ink dropping from a wiper that is placed furthest downstream in the wiping direction among the one or more wipers, and moreover the ink receiving member lets the ink drop onto the tray surface.

Still further objects of the disclosure as well as concrete advantages obtained by the disclosure will become more apparent from the description of an embodiment given below.

DETAILED DESCRIPTION

Hereinbelow, an embodiment of the present disclosure will be described with reference to the accompanying drawings.

Figure 1:
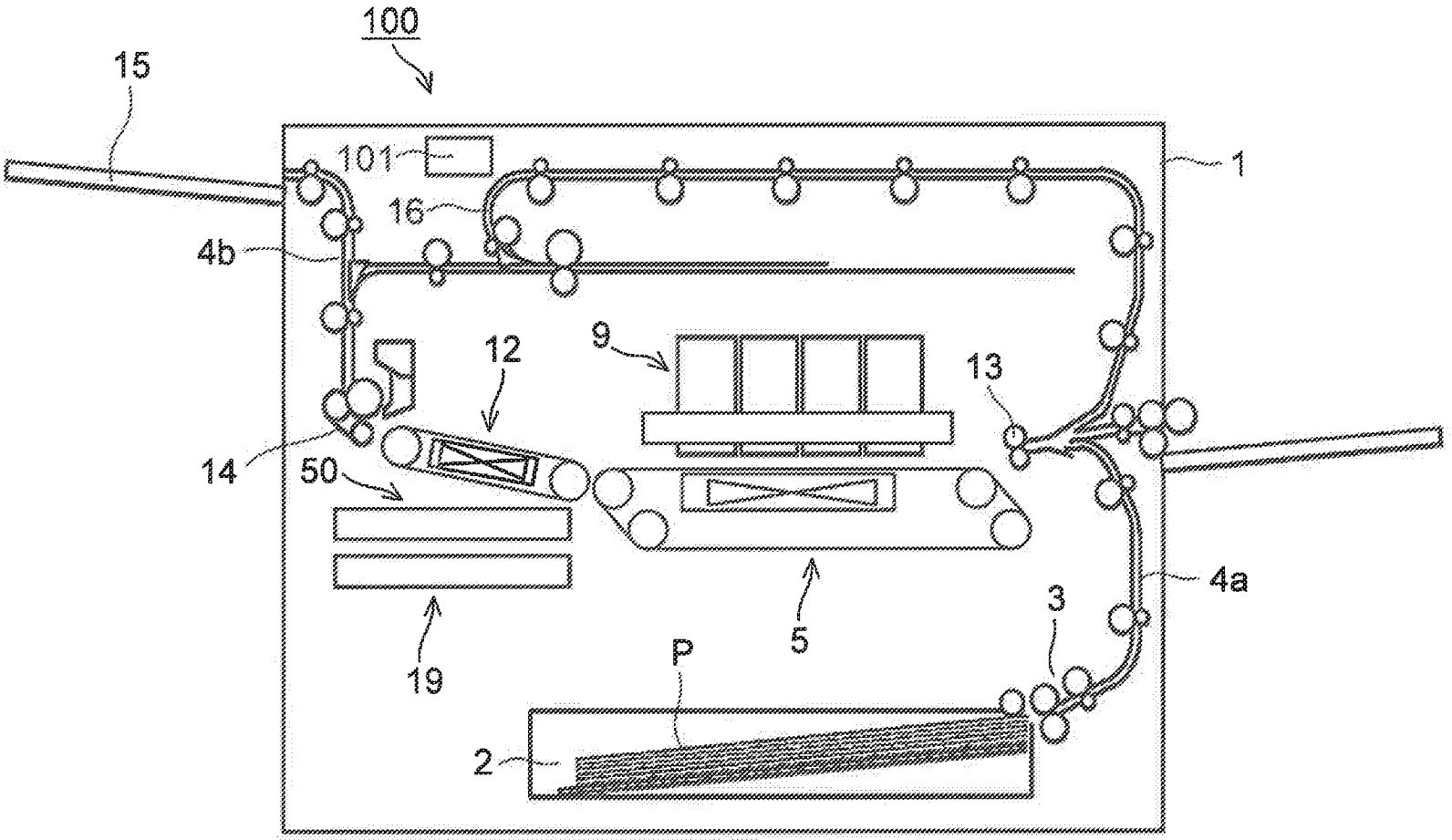
FIG. 1 is a view showing an outlined structure of a printer equipped with a wipe unit according to one embodiment of the present disclosure.

An ink jet type printer 100 (ink jet recording apparatus) equipped with a wipe unit 19 according to one embodiment of the disclosure will be described with reference to FIGS. 1 to 24. As shown in FIG. 1, in the printer 100, a sheet feed cassette 2, which is a sheet containing part, is placed below inside a printer main body 1. Paper sheets P, which are an example of recording media, are contained inside the sheet feed cassette 2. A sheet feed device 3 is placed on a sheet-conveyance downstream side of the sheet feed cassette 2, i.e., on the upper right side of the sheet feed cassette 2 in FIG. 1. By this sheet feed device 3, the sheets P are fed out, sheet by sheet, separately from each other toward the upper right side of the sheet feed cassette 2 as in FIG. 1.

The printer 100 also includes in its interior a first sheet conveyance path 4*a*. The first sheet conveyance path 4*a* is positioned, in relation to the sheet feed cassette 2, on the upper right side, toward which a sheet feed direction extends. A sheet P fed out from the sheet feed cassette 2 is conveyed vertically upward along a side face of the printer main body 1 by the first sheet conveyance path 4*a*.

A registration roller pair 13 is provided at a sheet-conveyance downstream end of the first sheet conveyance path 4*a*. Further, a first conveyance unit 5 and a recording part 9 are placed at a sheet-conveyance downstream-side proximity to the registration roller pair 13. The sheet P fed out from the sheet feed cassette 2 passes through the first sheet conveyance path 4*a* to reach the registration roller pair 13. The registration roller pair 13, while correcting any skewed feed of the sheet P, feeds out the sheet P toward the first conveyance unit 5 with measurement of a timing compatible with ink ejecting operation to be executed by the recording part 9.

A second conveyance unit 12 is placed on the sheet-conveyance downstream side (left side in FIG. 1) of the first conveyance unit 5. The sheet P having an ink image recorded thereon in the recording part 9 is fed to the second conveyance unit 12. Then, Ink having been ejected onto a surface of the sheet P is dried during its passage through the second conveyance unit 12.

A decurler part 14 is provided in proximity to a left side face of the printer main body 1 on the sheet-conveyance downstream side of the second conveyance unit 12. The sheet P with the ink dried in the second conveyance unit 12 is fed to the decurler part 14, where any curls having occurred to the sheet P are corrected.

A second sheet conveyance path 4*b* is provided on the sheet-conveyance downstream side (upper side in FIG. 1) of the decurler part 14. The sheet P having passed through the decurler part 14, when not subjected to double-side recording, is discharged from the second sheet conveyance path 4*b* onto a sheet discharge tray 15 which is provided externally on a left side face of the printer 100.

A reversal conveyance path 16 for executing double-side recording is provided in upper part of the printer main body 1 above the recording part 9 and the second conveyance unit 12. In a case where the double-side recording is executed, the sheet P that has ended recording onto a first surface and passed through the second conveyance unit 12 and the decurler part 14 is fed through the second sheet conveyance path 4*b* to the reversal conveyance path 16. The sheet P fed to the reversal conveyance path 16, subsequently switched over in conveyance direction for recording of a second surface, is fed rightward through upper part of the printer main body 1. Then, through the first sheet conveyance path 4*a* and the registration roller pair 13, the sheet P is fed to the first conveyance unit 5 once again with the second surface facing upward.

Further, the wipe unit 19 and a cap unit 50 are placed below the second conveyance unit 12. For execution of later-described purge operation, the wipe unit 19 is moved horizontally to under the recording part 9 to wipe off ink pushed out from ink ejection ports of recording heads and present on ink ejection surfaces, thus collecting the wiped-off ink. For capping of the ink ejection surfaces of the recording heads, the cap unit 50 is moved horizontally to under the recording part 9, and then moved further upward so as to be fitted to lower surfaces of the recording heads.

Figure 2:
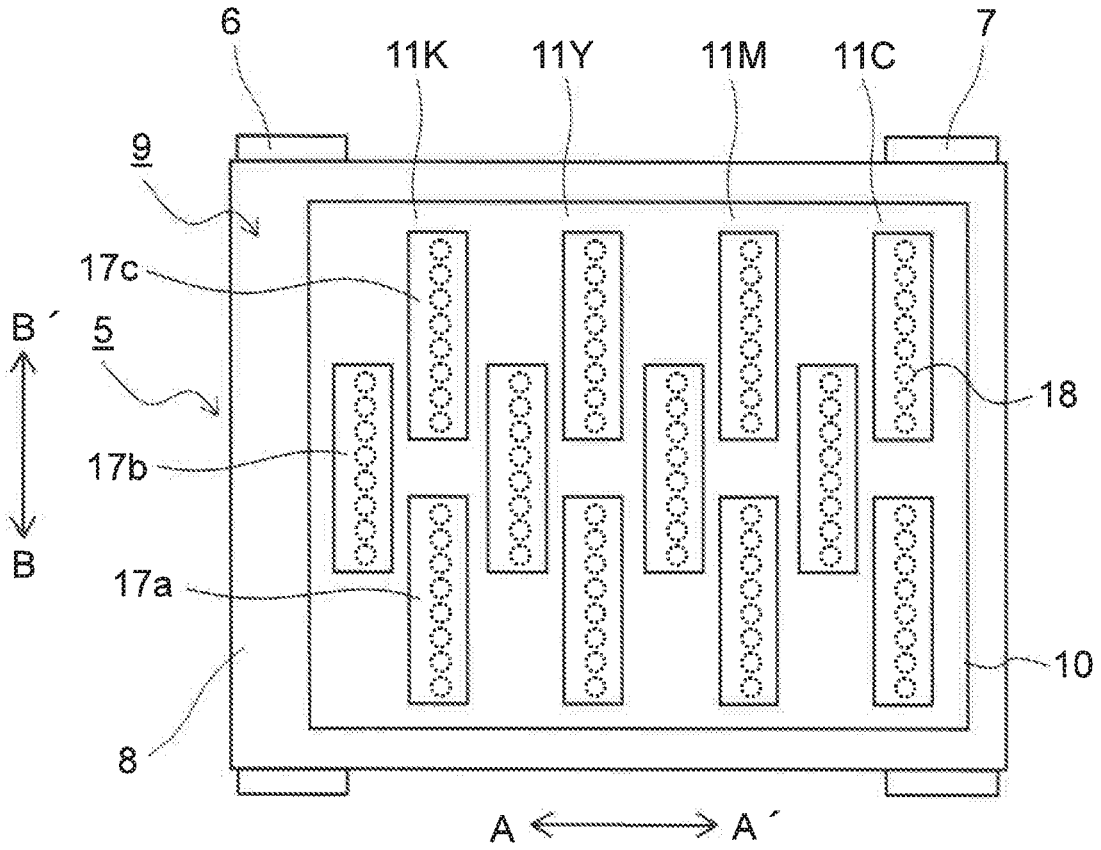
FIG. 2 is a view of a first conveyance unit and a recording part, as viewed from above, of the printer according to one embodiment of the disclosure.
Figure 3:
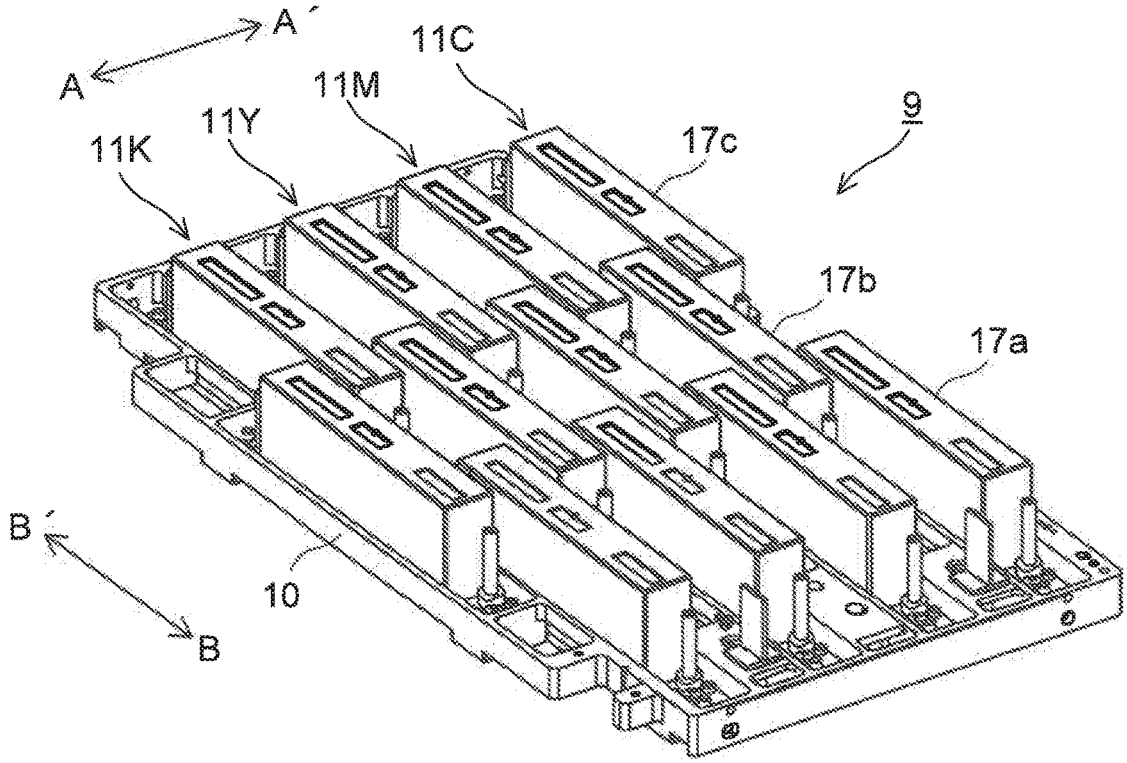
FIG. 3 is a view showing a structure of the recording part in the printer according to one embodiment of the disclosure.

The recording part 9, as shown in FIGS. 2 and 3, includes a head housing 10 as well as line heads 11C, 11M, 11Y, 11K held on the head housing 10. These line heads 11C to 11K are supported at such a height that a specified distance (e.g., 1 mm) is formed against a conveyance surface of a first conveyor belt 8 stretched over a plurality of rollers including a driving roller 6 and a driven roller 7. In those line heads 11C to 11K, a plurality (three in this case) of recording heads 17*a* to 17*c* are disposed in a staggered shape along a sheet widthwise direction (arrow BB' direction) perpendicular to the sheet conveyance direction (arrow A direction).

Figure 4:
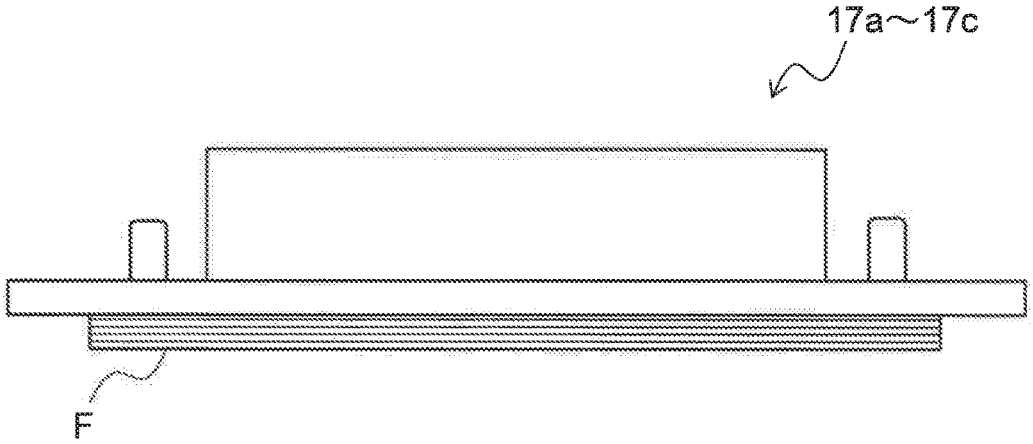
FIG. 4 is a view showing a structure of recording heads making up line heads of the recording part in the printer according to one embodiment of the disclosure.
Figure 5:
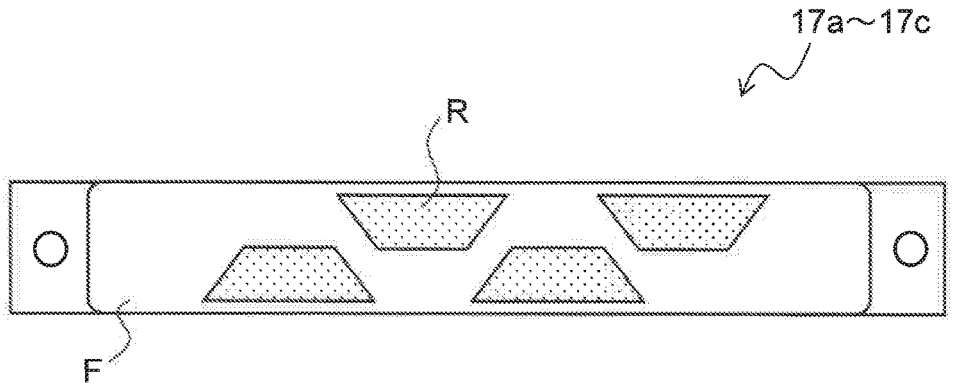
FIG. 5 is a view showing a recording head in the printer according to one embodiment of the disclosure, as viewed from an ink ejection surface side.

On ink ejection surfaces F of the recording heads 17*a* to 17*c*, ink ejection areas R with a multiplicity of ink ejection ports 18 (see FIG. 2) arrayed thereon are provided as shown in FIGS. 4 and 5. In addition, since the recording heads 17*a* to 17*c* are all identical in shape and makeup, the recording heads 17*a* to 17*c* are represented by one view in FIGS. 4 and 5.

Four-color (cyan, magenta, yellow and black) inks stored in their respective ink tanks (not shown) are supplied to the recording heads 17*a* to 17*c*, which constitute each of the line heads 11C to 11K, on a color basis of the line heads 11C to 11K.

According to control signals from a control section 101 (see FIG. 1) that controls the whole printer 100, each of the recording heads 17*a* to 17*c*, in response to image data received from an external computer or the like, ejects ink through the ink ejection ports 18 toward the sheet P being conveyed as it is sucked and held on the conveyance surface of the first conveyor belt 8. As a result of this, a color image in which four-color inks of cyan, magenta, yellow and black are superimposed on one another is formed on the sheet P lying on the first conveyor belt 8.

In this printer 100, with an aim of cleaning the ink ejection surfaces F of the recording heads 17*a* to 17*c*, ink is forcedly discharged from the ink ejection ports 18 of all the recording heads 17*a* to 17*c* at each printing start after long-time halts as well as during each interval between printing operations. Then, the ink on the ink ejection surfaces F is wiped off by later-described wipers 35*a* to 35*c* (see FIG. 12) for a next printing operation.

Next, the structure of the cap unit 50 and the wipe unit 19 as well as their vicinities will be described in detail.

Figure 6:
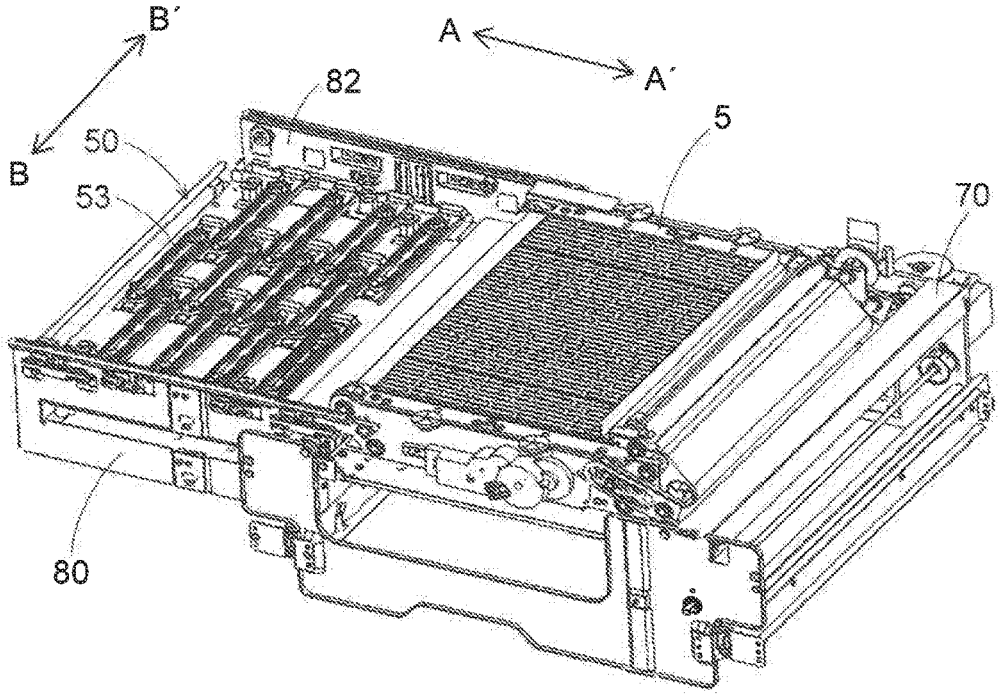
FIG. 6 is a view showing a structure of a cap unit, the first conveyance unit, and the like in the printer according to one embodiment of the disclosure, with the first conveyance unit set in a moved-up position.
Figure 7:
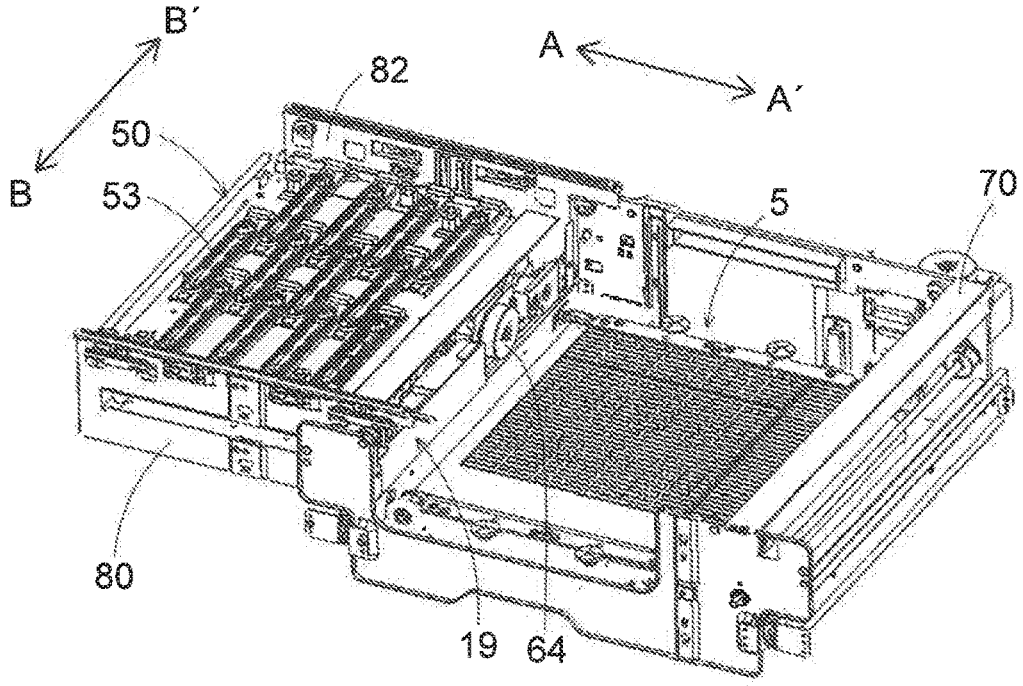
FIG. 7 is a view showing a structure of the cap unit, the first conveyance unit, and the like in the printer according to one embodiment of the disclosure, with the first conveyance unit set in a moved-down position.

The first conveyance unit 5, as shown in FIGS. 6 and 7, is housed in a housing frame 70. The first conveyance unit 5 is so made up as to be up/down movable by a conveyance up/down moving mechanism (not shown) composed of an up/down movement driving source, a gear train, and the like. For a printing operation, the first conveyance unit 5 is set at a moved-up position (position of FIG. 6), being proximate to the ink ejection surfaces F of the recording heads 17*a* to 17*c*. Also, for later-described recovery operation and capping operation of the recording heads 17*a* to 17*c*, the first conveyance unit 5 is set at a moved-down position (position of FIG. 7).

Figure 8:
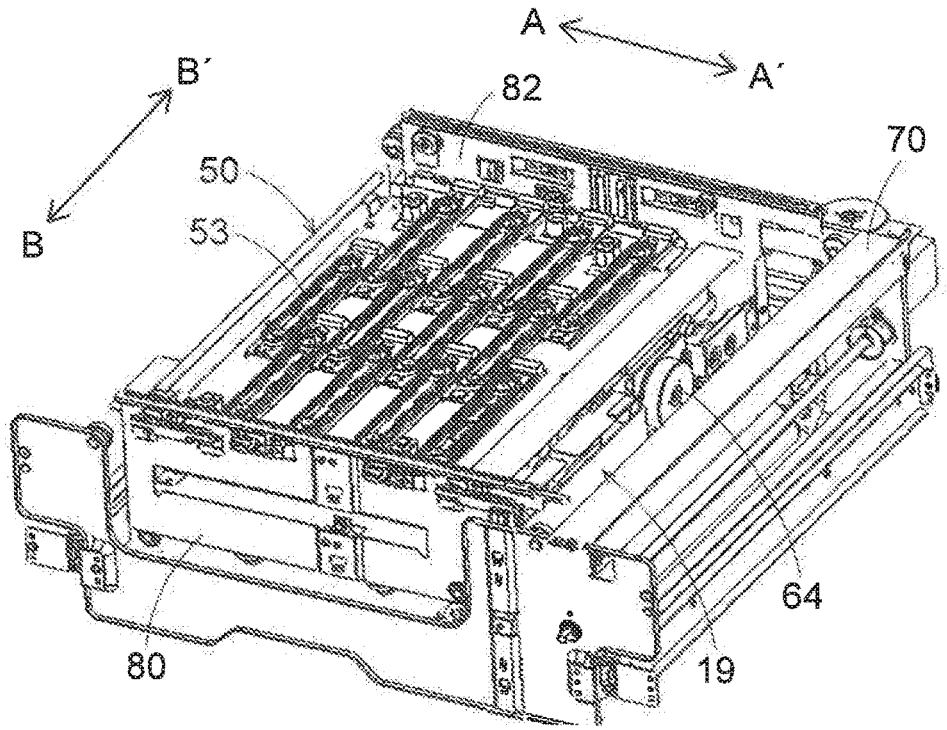
FIG. 8 is a view showing a structure of the cap unit and others in the printer according to one embodiment of the disclosure, with the cap unit and the wipe unit set in a first position.
Figure 9:
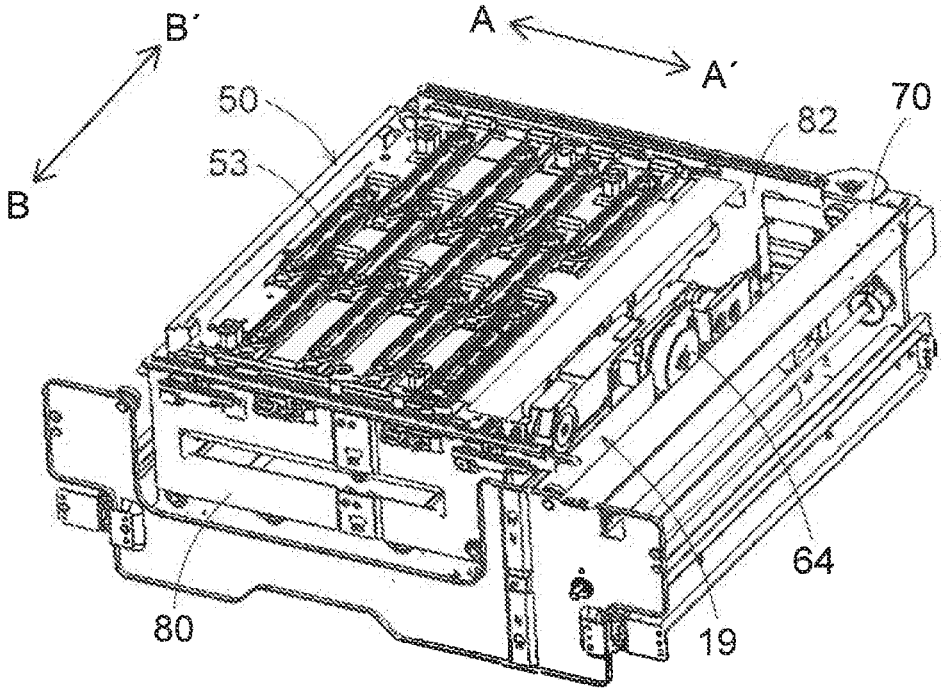
FIG. 9 is a view showing a state resulting when the cap unit and the wipe unit in the state of FIG. 8 have been moved up.

The cap unit 50, as shown in FIGS. 7 and 8, is so made up as to be reciprocatively movable between a first position (position of FIG. 8) just under the recording part 9 and a second position (position of FIG. 7) to which the cap unit 50 withdraws horizontally (in arrow A direction) from the first position. In addition, while the cap unit 50 is set in the first position, the first conveyance unit 5 is set in the moved-down position. Also, as shown in FIGS. 8 and 9, the cap unit 50 is so made up as to be vertically up/down movable in the first position.

For printing operations and recovery operations, the cap unit 50 is set to the second position (position of FIG. 6). The cap unit 50 is so made up as to, for capping operation, move upward in the first position (position of FIGS. 8 and 9) to fulfill the capping operation for the recording heads 17*a* to 17*c*. As will be described later, the cap unit 50 is so designed as to be couplable and decouplable with the wipe unit 19 in the second position. Horizontal and vertical movements of the cap unit 50 are fulfilled by movement of the wipe unit 19 coupled with the cap unit 50.

Figure 10:
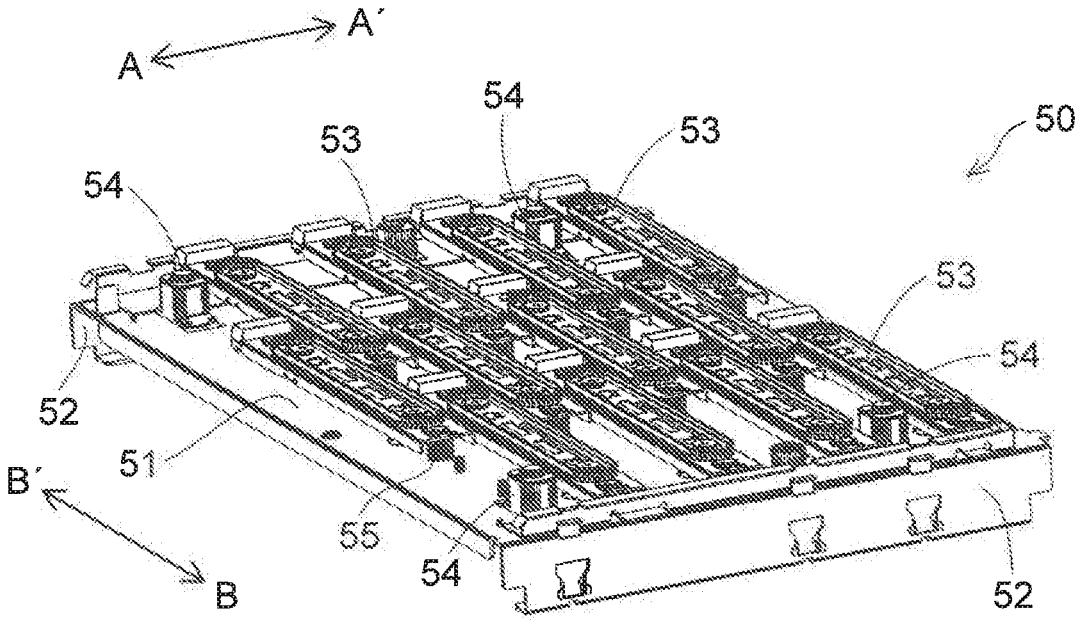
FIG. 10 is a view showing a structure of the cap unit in the printer according to one embodiment of the disclosure.

The cap unit 50, as shown in FIG. 10, includes a cap tray 51 made of sheet metal, a pair of tray side plates 52 formed at sheet-widthwise (arrow-BB'-direction) both ends of the cap tray 51, twelve recessed-shaped cap parts 53 placed on an upper surface of the cap tray 51, and four heightwise positioning protrusions 54.

The cap parts 53 are placed at positions corresponding to the recording heads 17*a* to 17*c*, respectively. Therefore, upward movement of the cap unit 50 in the first position as shown in FIG. 9 allows the cap parts 53 to fulfill the capping of the ink ejection surfaces F of the recording heads 17*a* to 17*c*. When the cap unit 50 is moved up toward the recording part 9 to fulfill the capping of the recording heads 17*a* to 17*c*, the heightwise positioning protrusions 54 are brought into contact with the housing 10 of the recording part 9, thereby fulfilling heightwise positioning of the cap tray 51. Cap springs 55 (see FIG. 10) each formed of a compression spring are placed between lower portions of longitudinal (arrow-BB'-direction) both ends of each cap part 53 and the cap tray 51. Contact between the cap parts 53 and the ink ejection surfaces F is maintained in a constant state by the cap springs 55.

Figure 11:
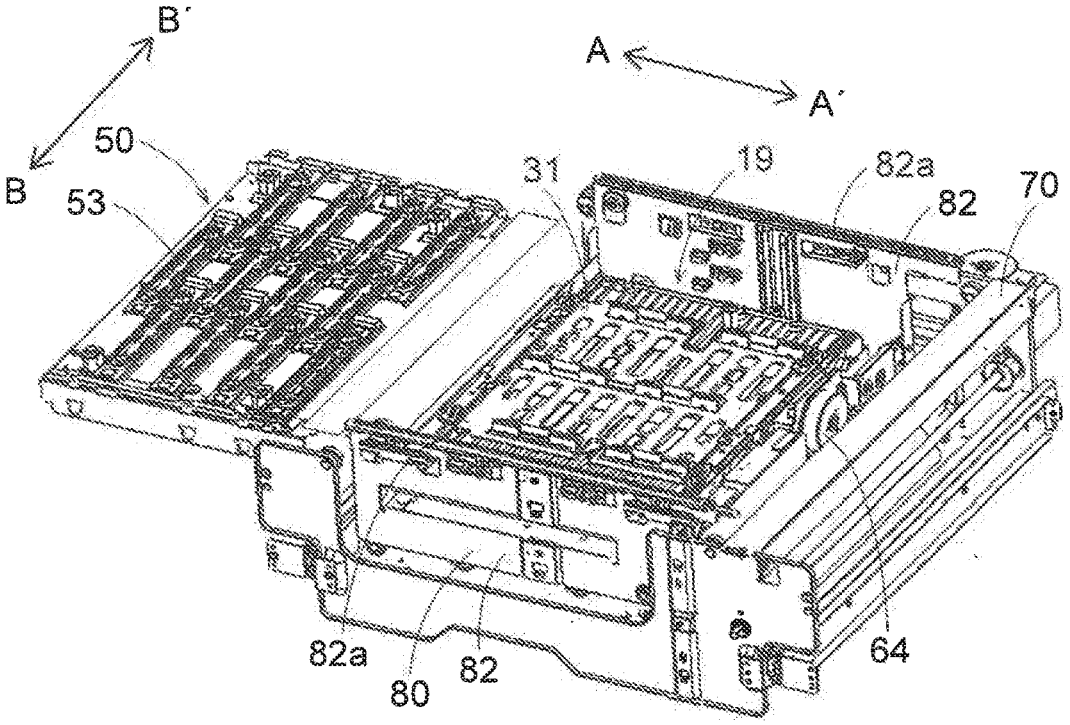
FIG. 11 is a view showing a structure of the cap unit, the wipe unit, and the like in the printer according to one embodiment of the disclosure, where the cap unit is set in a second position and the wipe unit is set in the first position.

The wipe unit 19, as shown in FIGS. 7 and 11, is so made up as to be reciprocatively movable between a first position (position of FIG. 11) just under the recording part 9 and the second position (position of FIG. 7) to which the wipe unit 19 withdraws horizontally (in arrow A direction) from the first position. In addition, while the wipe unit 19 is set in the first position, the first conveyance unit 5 is set in the moved-down position. Also, as shown in FIGS. 11 and 12, the wipe unit 19 is so made up as to be vertically up/down movable in the first position.

For a printing operation, the wipe unit 19 is set to the second position. The wipe unit 19 is so made up to move upward in the first position (position of FIG. 11) for recovery operations and capping operations.

Figure 12:
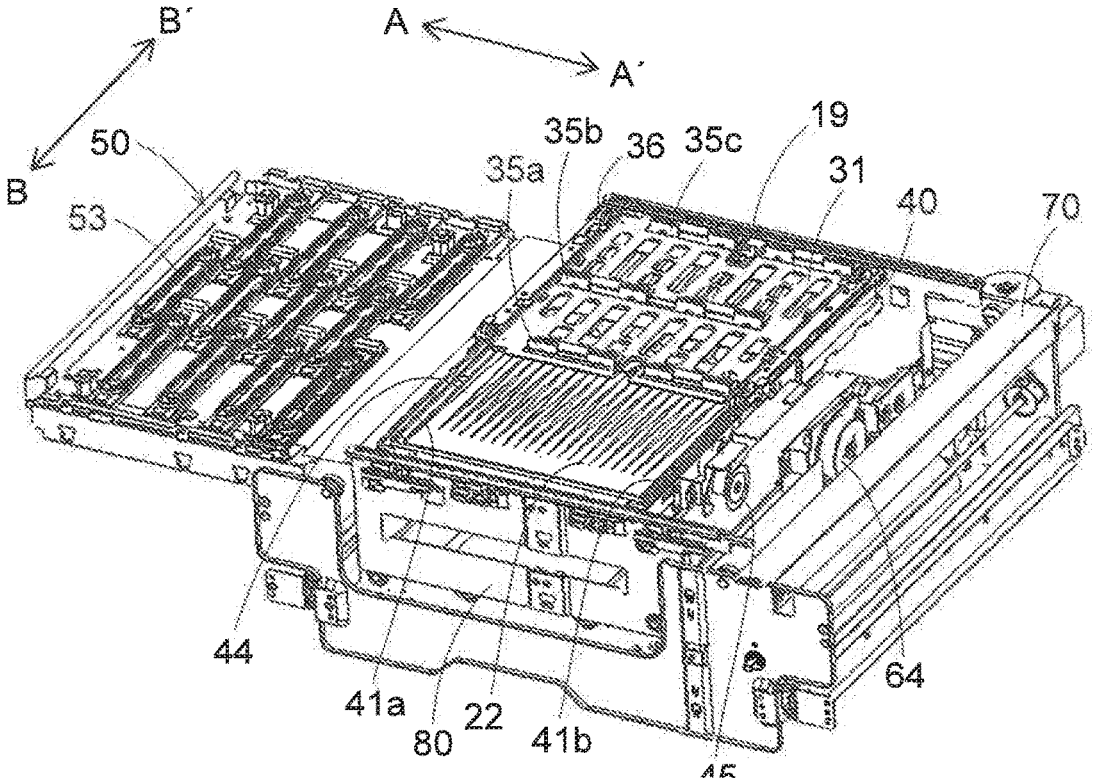
FIG. 12 is a view showing a state resulting when the wipe unit in the state of FIG. 11 has been moved up.
Figure 13:
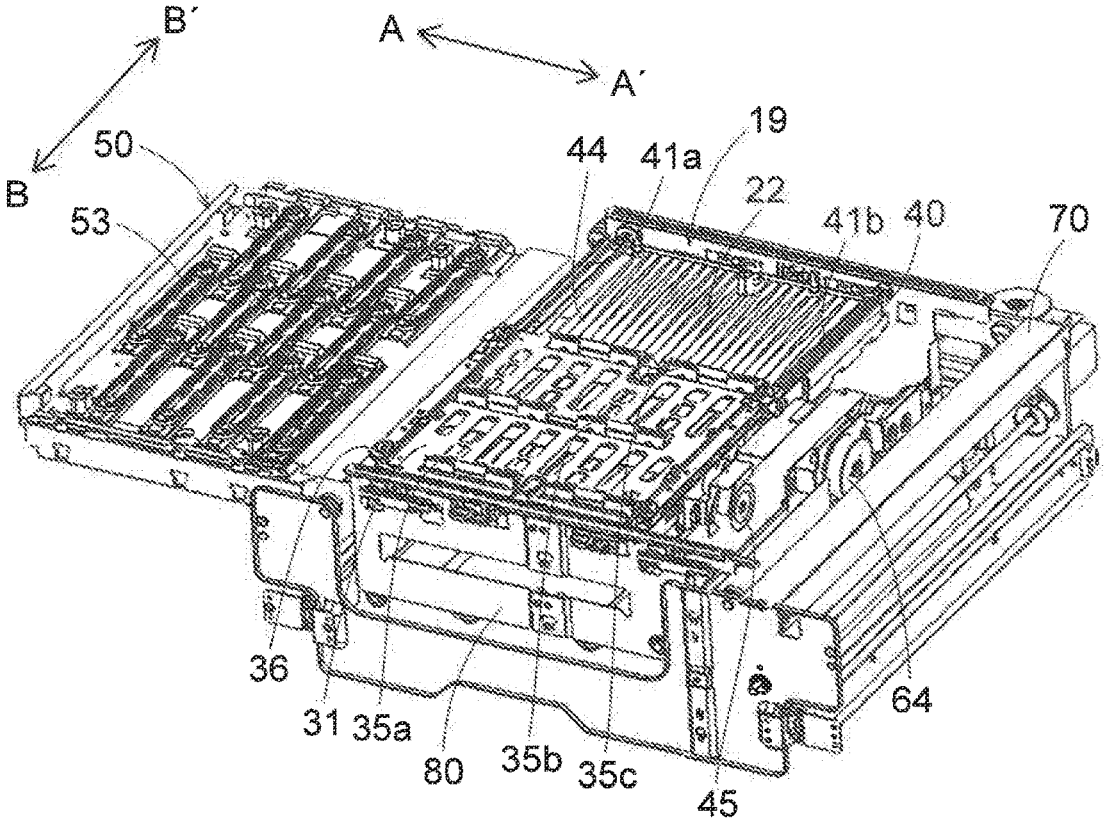
FIG. 13 is a view showing a state resulting when a wiper carriage in the state of FIG. 12 has been moved in an arrow B direction.

The wipe unit 19, as shown in FIGS. 12 and 13, is composed of a generally rectangular wiper carriage 31 on which a plurality of wipers 35*a* to 35*c* are fixed, and a support frame 40 for supporting the wiper carriage 31.

Rail parts 41*a* and 41 *b* are formed at terminal edges of an upper surface of the support frame 40 which are opposed to each other in the arrow AA' direction. Rollers 36 provided at four corners of the wiper carriage 31 are brought into contact with the rail parts 41*a* and 41*b*, so that the wiper carriage 31 is supported on the support frame 40 so as to be slidable in the arrow BB' direction.

A wiper carriage moving motor 45 for moving the wiper carriage 31 in the horizontal direction (arrow BB' direction), and a gear train (not shown) to be engaged with rack teeth (not shown) of the wiper carriage moving motor 45 and the wiper carriage 31, are fitted outside the support frame 40. As the wiper carriage moving motor 45 is rotated forward and reverse, the gear train is rotated forward and reverse, so that the wiper carriage 31 is reciprocatively moved in the horizontal direction (arrow BB' direction).

The wipers 35*a* to 35*c* are elastic members (e.g., rubber members formed from EPDM) for wiping off ink pushed out from the ink ejection ports 18 of the recording heads 17*a* to 17*c* and present on the ink ejection surfaces F. The wipers 35*a* to 35*c* are brought into generally vertical pressure contact with wiping start positions outside the ink ejection areas R (see FIG. 5) in which the ink ejection ports 18 are opened. Then, by movement of the wiper carriage 31, the wipers 35*a* to 35*c* wipe off the ink ejection surfaces F including the ink ejection areas R in a specified direction (arrow B direction FIG. 12).

Four wipers 35*a* are disposed with generally equal intervals, and likewise, four wipers 35*b* and four wipers 35*c* are also disposed with generally equal intervals. The wipers 35*a* and 35*c* are placed at positions corresponding to the recording heads 17*a* and 17*c* (see FIG. 3), respectively, which compose the line heads 11C to 11K, respectively. Also, the wipers 35*b* are disposed at positions corresponding to the recording heads 17*b* (see FIG. 3), respectively, which compose the line heads 11C to 11K, respectively. In addition, the wipers 35*b* are fixed so as to be shifted from the wipers 35*a* and 35*c* each with a specified distance in a direction (arrow AA' direction) perpendicular to the moving direction of the wiper carriage 31.

A collection tray 44 for collecting waste ink wiped off from the ink ejection surfaces F by the wipers 35*a* to 35*c* is placed on the upper surface of the support frame 40. Waste ink collected onto the collection tray 44 is stored in a waste ink tank (not shown). In addition, the structure of around the collection tray 44 will be described later.

The wipe unit 19, as shown in FIG. 7, is housed in a carriage 80 which is tilted-U shape in cross section. Also, the wipe unit 19 is placed below the cap unit 50 in the second position. When moved in the horizontal direction (arrow AA' direction) as shown in FIGS. 7 and 11, the wipe unit 19 is moved integrally with the carriage 80; when moved up and down as shown in FIGS. 11 and 12, the wipe unit 19 is moved up and down relative to the carriage 80.

Figure 14:
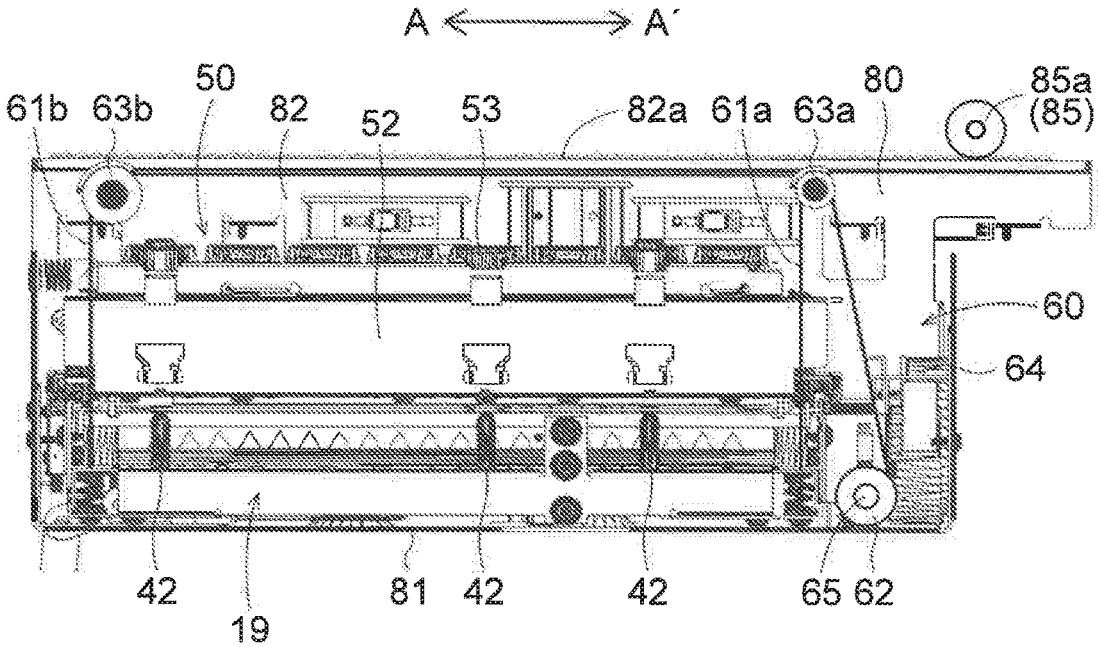
FIG. 14 is a view showing a structure of around a unit up/down moving mechanism in the printer according to one embodiment of the disclosure.

The carriage 80 is composed of a carriage bottom plate 81 (see FIG. 14) which is made of sheet metal and on which the wipe unit 19 is to be mounted, and a pair of carriage side plates 82 erectly provided at sheet-widthwise (arrow-BB'-direction) both ends of the carriage bottom plate 81. The carriage side plates 82 are so provided as to be movable in sliding contact with carriage support rails (not shown) of the printer main body 1. As shown in FIG. 14, a rack part 82*a* having rack teeth is formed on an upper surface of each carriage side plate 82. A gear 85*a* is engaged with the rack part 82*a*, and a gear train including the gear 85*a* is linked with a carriage driving source (not shown) implemented by a motor. As the carriage driving source is rotated forward and reverse, the gear train is rotated forward and reverse, so that the carriage 80 is reciprocatively moved between the first position and the second position. It is noted that the gear train including the gear 85*a* and the carriage driving source constitute a unit horizontal moving mechanism 85 for moving the cap unit 50 and the wipe unit 19 in the horizontal direction.

As shown in FIG. 14, a unit up/down moving mechanism 60 for moving up and down the wipe unit 19 is provided inside the carriage 80. The unit up/down moving mechanism 60 includes wires 61*a* and 61*b*, a take-up pulley 62 for taking up the wires 61*a* and 61*b*, pulleys 63*a* and 63*b* for switching directions of the wires 61*a* and 61*b*, and a take-up driving motor (take-up driving source) 64.

The wire 61*a* is fitted up so as to extend from the take-up pulley 62 via the pulley 63*a* to arrow A'-sided lower part of the wipe unit 19. The wire 61*b* is fitted up so as to extend from the take-up pulley 62 via the pulleys 63*a* and 63*b* to arrow A-sided lower part of the wipe unit 19. All of the wires 61*a* and 61*b*, the take-up pulley 62, and the pulleys 63*a* and 63*b* are provided each one for both of two sides in the arrow BB' direction (I.e., front side and depth side for the viewer in FIG. 14). A pair of take-up pulleys 62 are fixed to both ends of one rotating shaft 65. A rotating shaft gear (not shown) to be engaged with the gear train (not shown) linked with the take-up driving motor 64 is fixed to the rotating shaft 65. As the take-up driving motor 64 is rotated forward and reverse, the take-up pulleys 62 are rotated forward and reverse.

Figure 15:
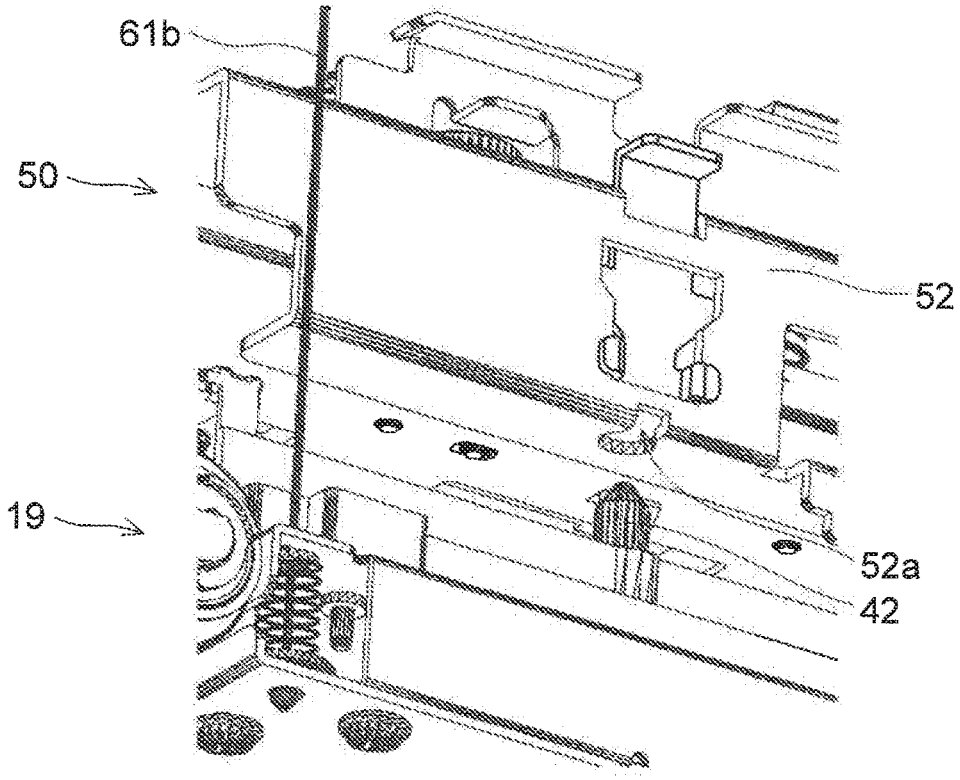
FIG. 15 is a view showing a structure of around a coupling pin and a push-up piece in the printer according to one embodiment of the disclosure, with the wipe unit and the cap unit uncoupled to each other.

As shown in FIGS. 14 and 15, a plurality of upward-extending coupling pins 42 are provided in the wipe unit 19. In a lower surface of a tray side plate 52 of the cap unit 50, a coupling hole 52*a* (see FIG. 15) is formed at a position corresponding to each coupling pin 42. The coupling pins 42 and the coupling holes 52*a* constitute a coupling mechanism for coupling or decoupling the cap unit 50 and the wipe unit 19 to and from each other.

Figure 16:
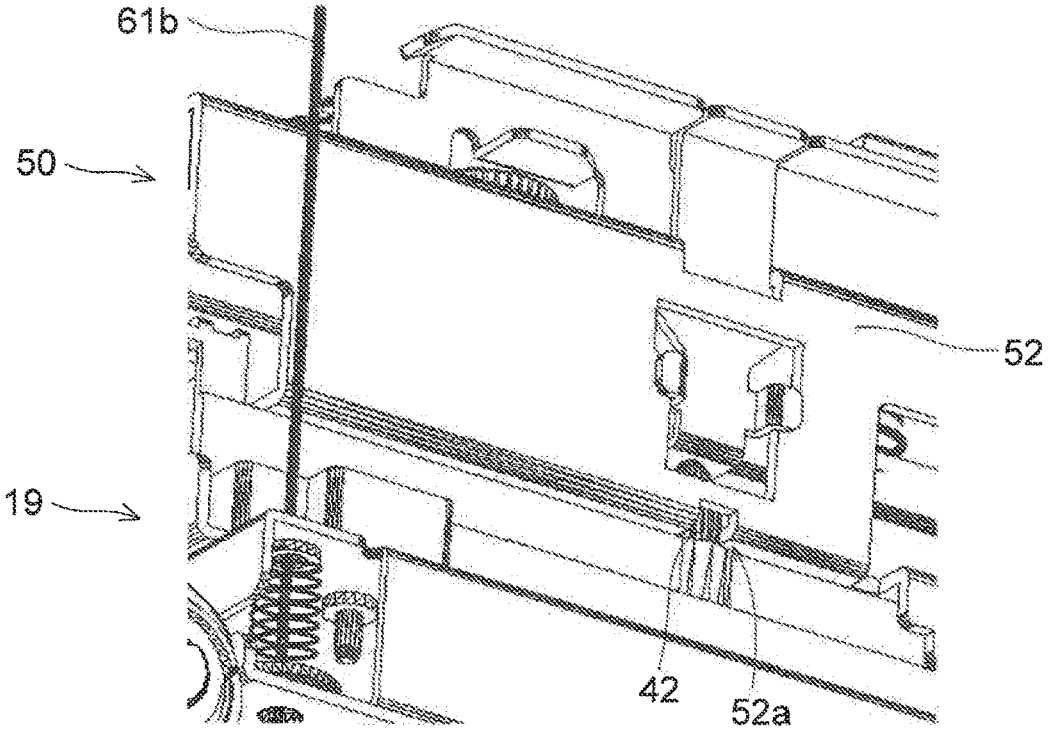
FIG. 16 is a view showing a structure of around the coupling pin and the push-up piece in the printer according to one embodiment of the disclosure, with the wipe unit and the cap unit coupled to each other.

In a state in which the wipe unit 19 has been moved down in the second position (state of FIG. 14, i.e., state in which the wipe unit 19 is set at a first height position), the coupling pins 42 are not inserted into the coupling holes 52*a* as shown in FIG. 15, so that the wipe unit 19 and the cap unit 50 are not coupled to (are decoupled from) each other. Meanwhile, when the wipe unit 19 is moved up in the second position (set to a second height position higher than the first height position), the coupling pins 42 are inserted into the coupling holes 52*a* as shown in FIG. 16, so that the wipe unit 19 and the cap unit 50 are coupled to each other. As a result, the cap unit 50 is integrated with the wipe unit 19 so as to be movable in both the horizontal direction and the up/down direction.

In addition, a cap supporting part (not shown) for supporting the cap unit 50 with the wipe unit 19 and the cap unit 50 not coupled to each other (decoupled from each other) is provided in the second position. Also provided in the second position is a lid member (not shown) for protecting the cap parts 53 by making close contact with the cap parts 53 of the cap unit 50 in the state in which the wipe unit 19 and the cap unit 50 are not coupled to each other (in a state other than a capping operation, i.e., in a printing operation or a recovery operation). The lid member (not shown), by making close contact, from above, with the cap parts 53, prevents deposition of foreign matters such as dust and paper dust onto the upper surfaces (surfaces to be in close contact with the ink ejection surfaces F) of the cap parts 53, and moreover suppresses a possibility that water content inside the cap parts 53 may evaporate and dissipate.

Next, the structure of around the wipers 35*a* to 35*c* will be described in detail.

Figure 17:
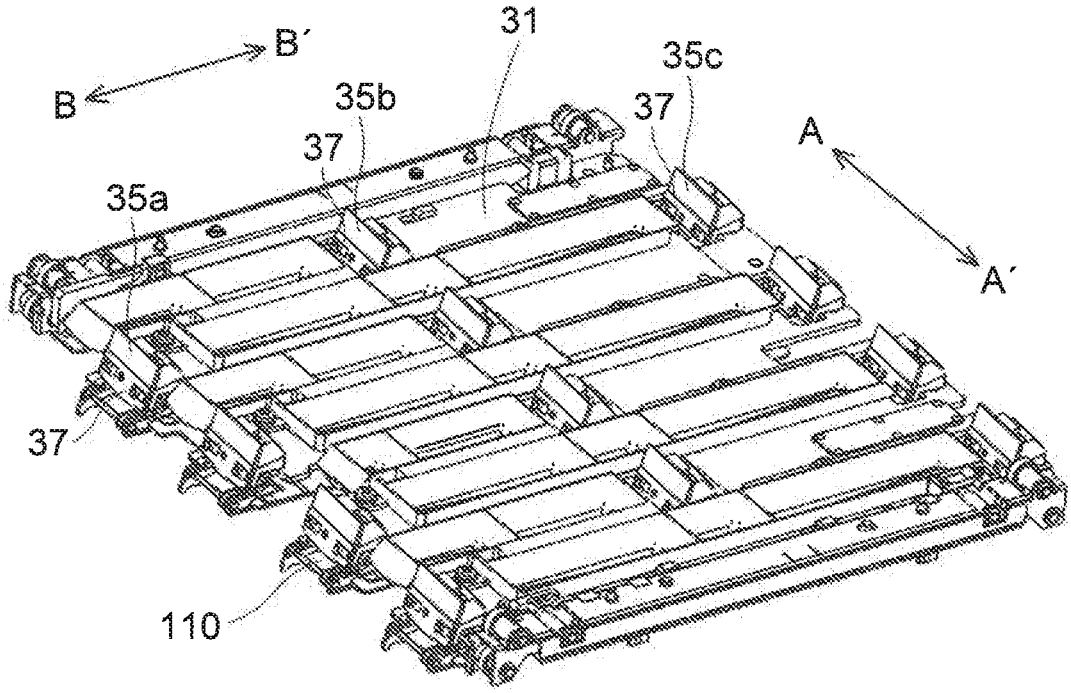
FIG. 17 is a view showing a structure of the wiper carriage in the wipe unit according to one embodiment of the disclosure.

As shown in FIG. 17, the wipers 35*a* to 35*c* are fixed to the wiper carriage 31 by using a wiper fixing member 37. In this embodiment, the wipers 35*a* to 35*c* are fixed to the wiper carriage 31 by using the wiper fixing member 37 and a fixation auxiliary member 38 (see FIG. 18).

Figure 18:
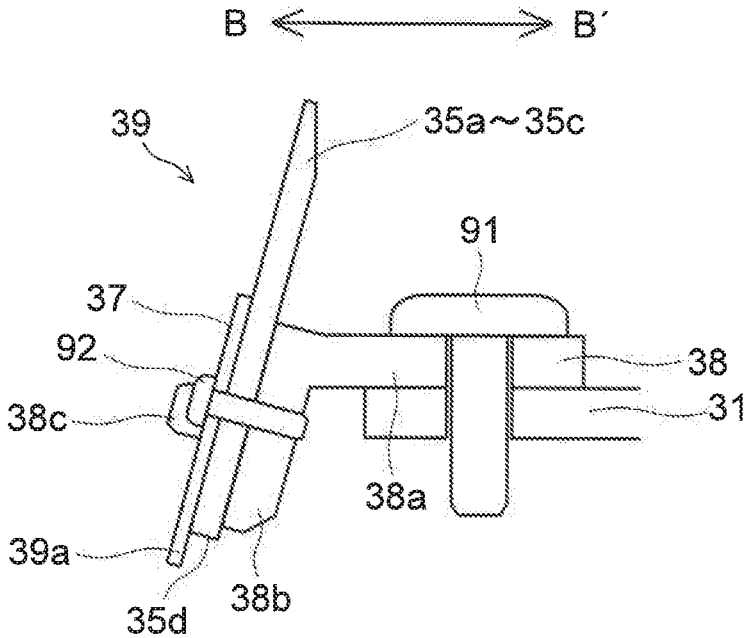
FIG. 18 is a view showing a structure of a wiping part in the wipe unit according to one embodiment of the disclosure.

More specifically, as shown in FIG. 18, the fixation auxiliary member 38, which is made of resin and is generally L-shaped in cross section, is fixed with a screw 91 at a specified position of the wiper carriage 31, which is made of sheet metal. The fixation auxiliary member 38 includes a fixed portion 38*a* which extends horizontally and is fixed to the wiper carriage 31, and a holding portion 38*b* which extends downward from a wiping-direction (arrow-B-direction) downstream-side end portion of the fixed portion 38*a*.

A pair of positioning bosses 38*c* (see also FIG. 19) are provided on an arrow B-side surface of the holding portion 38*b*. Then, each of the wipers 35*a* to 35*c* is fixed to the holding portion 38*b* with a screw 92 in a state in which the wipers 35*a* to 35*c* are each positioned by the positioning bosses 38*c* and moreover sandwiched between the holding portion 38*b* and the wiper fixing member 37.

Figure 20:
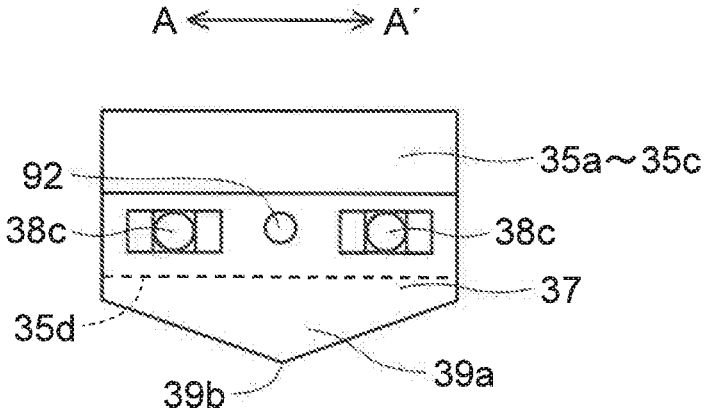
FIG. 20 is a view showing a structure of the wiper and a wiper fixing member in the wipe unit according to one embodiment of the disclosure.

In this embodiment, the wipers 35*a* to 35*c*, the wiper fixing member 37, and the fixation auxiliary member 38 constitute a wiping part 39. The wiping part 39 includes an ink dropping part 39*a* for allowing ink wiped off by the wipers 35*a* to 35*c* to drop onto a later-described ink receiving member 110 or a tray surface 22 of a collection tray 44. In this case, since the wiper fixing member 37 is formed so as to extend up to lower than a lower end 35*d* of each wiper 35*a* to 35*c* as shown in FIGS. 18 and 20, ink wiped off by the wipers 35*a* to 35*c* is moved along the wipers 35*a* to 35*c* to the wiper fixing member 37, dropping off from a lower end portion of the wiper fixing member 37. That is, the lower end portion of the wiper fixing member 37 serves as the ink dropping part 39*a*.

As shown in FIG. 20, each of the wipers 35*a* to 35*c* is formed into a rectangular shape as viewed in the wiping direction (arrow B direction). The wiper fixing member 37 is so formed as to be generally equal in arrow-AA'-direction length to the wipers 35*a* to 35*c*. Further, the lower end portion (ink dropping part 39*a*) of the wiper fixing member 37 is so formed as to become shorter and shorter, as viewed in a downward direction, in terms of arrow-AA'-direction length. In this case, the lower end portion (Ink dropping part 39*a*) of the wiper fixing member 37 is formed into an inverted triangle shape. As a result of this, ink wiped off by the wipers 35*a* to 35*c* drops off from a lowermost end 39*b* of the ink dropping part 39*a*.

Figure 19:
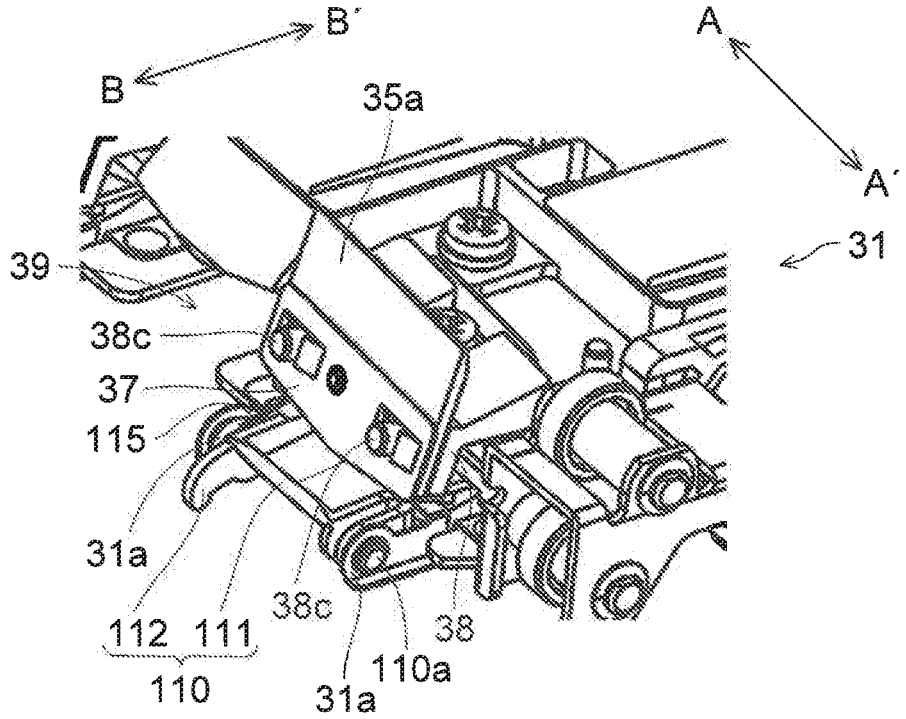
FIG. 19 is a view showing a structure of around a wiper and an ink receiving member in the wipe unit according to one embodiment of the disclosure.

In this embodiment, as shown in FIGS. 17 and 19, the wiper carriage 31 is equipped with a recessed-shaped ink receiving member 110 for receiving ink wiped off by the wiper 35*a* and dropping from the wiper 35*a*. The ink receiving member 110 is provided for the wiper 35*a* placed furthest downstream among the wipers 35*a* to 35*c*, and not provided for the wipers 35*b* and 35*c*.

As shown in FIG. 19, a pivoting shaft 110*a* extending in the arrow AA' direction is provided in the ink receiving member 110. The ink receiving member 110 is supported on a pair of support pieces 31*a* of the wiper carriage 31 so as to be pivotable about the pivoting shaft 110*a*.

Figure 21:
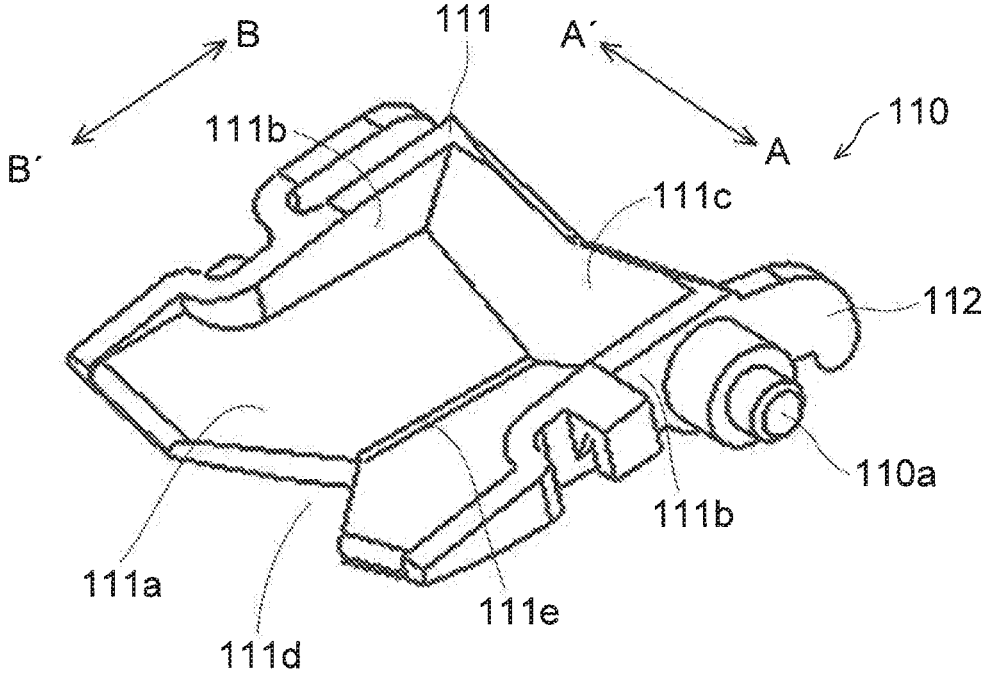
FIG. 21 is a view showing a structure of the ink receiving member in the wipe unit according to one embodiment of the disclosure.

As shown in FIG. 21, the ink receiving member 110 is composed of a recessed-shaped ink collecting container 111 with its top face opened, and a contact piece 112 protruding from the ink collecting container 111 to the wiping-direction downstream side. The ink collecting container 111 includes a sloped bottom surface 111*a* sloped downward toward an arrow-AA'-direction central portion, a pair of side walls 111*b* erectly provided from arrow-AA'-direction both ends of the sloped bottom surface 111*a*, and a side wall 111*c* erectly provided from an arrow-B-direction end portion of the sloped bottom surface 111*a*. A cutout 111*d* serving as an ink discharge part is formed at an arrow-AA'-direction central portion in an arrow-B'-direction end portion of the sloped bottom surface 111*a*.

Further, the arrow-AA'-direction central portion of the ink collecting container 111 (arrow-AA'-direction central portion 111*e* of the sloped bottom surface 111*a*) is placed just under an arrow-AA'-direction central portion (lowermost end 39*b*) of the ink dropping part 39*a* (see FIG. 20). As shown in FIG. 19, an arrow-AA'-direction length of the ink receiving member 110 is shorter than an arrow-AA'-direction length of the wiping part 39.

Figure 22:
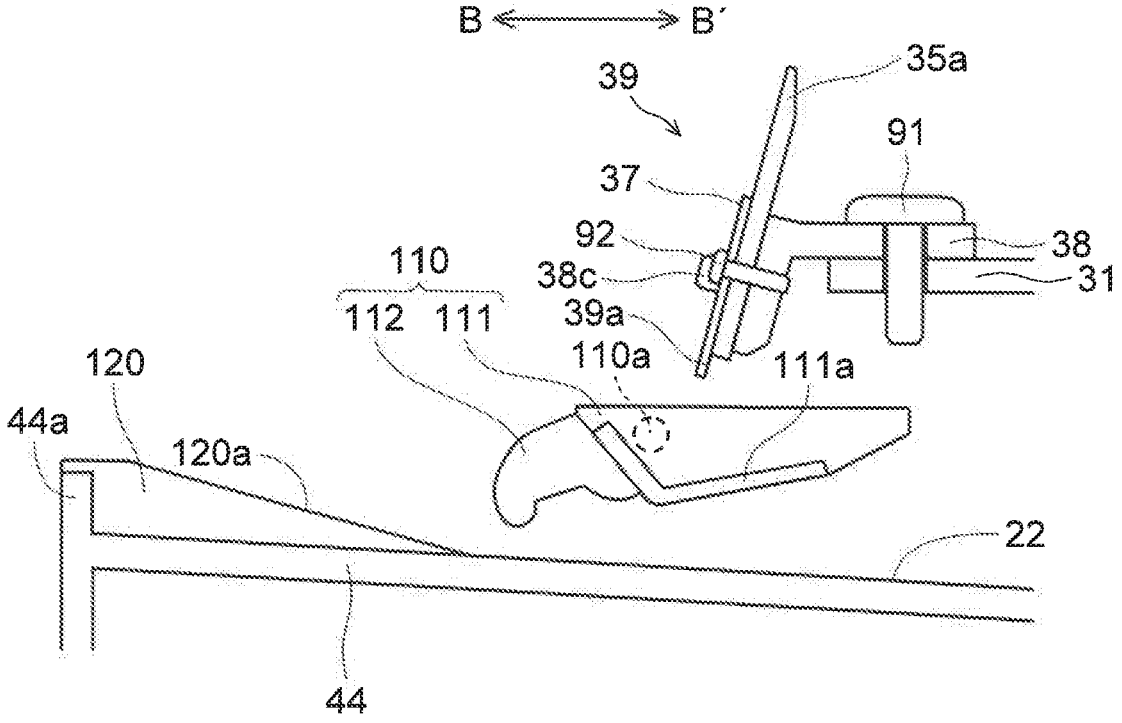
FIG. 22 is a view showing a structure of around the wiper, the ink receiving member, and a collection tray in the wipe unit according to one embodiment of the disclosure, where the ink receiving member is set in a storage posture.

In this case, the ink receiving member 110 is switched over between a storage posture (posture of FIG. 22) in which ink is stored into the ink collecting container 111, and a discharge posture (posture of FIG. 23) in which ink is discharged onto the collection tray 44 by the ink receiving member 110 being pivoted in the clockwise direction (first pivotal direction) as viewed in FIG. 22 from the storage posture, where the clockwise pivoting of the ink receiving member 110 causes its wiping-direction upstream end (right end of FIG. 22) to approach a later-described tray surface 22 of the collection tray 44.

More specifically, as shown in FIG. 22, the ink receiving member 110 is biased in the counterclockwise direction of FIG. 22 (second pivotal direction) by a biasing member 115 (see FIG. 19) formed of a torsion spring or the like provided on the pivoting shaft 110*a*. Also provided in the wiper carriage 31 is a restricting part (not shown) which is brought into contact with the ink receiving member 110 to restrict counterclockwise pivotal motion of the ink receiving member 110. As a result of this, the ink receiving member 110 is held in the storage posture shown in FIG. 22.

A contact portion 120 which is brought into contact with the contact piece 112 of the ink receiving member 110 to make the ink receiving member 110 pivoted from the storage posture to the discharge posture is provided at a wiping-direction downstream end portion of the collection tray 44. The contact portion 120 is provided for every contact piece 112. The contact portion 120 is so provided as to protrude from a wiping-direction downstream-side side face 44*a* of the collection tray 44 toward the wiping-direction upstream side. Therefore, the contact piece 112 of the ink receiving member 110 is brought into contact with the contact portion 120 while the wiper carriage 31 is set in the wiping-direction furthest downstream position (position of FIGS. 13 and 23).

The contact portion 120 has a sloped surface 120*a* (see also FIG. 22) which is upwardly sloped toward the wiping-direction downstream side and which is to be brought into contact with the contact piece 112. While the wiper carriage 31 is moved from upstream side to downstream side of the wiping direction, the ink receiving member 110 is held in the storage posture until the contact piece 112 comes into contact with the contact portion 120. Then, as the contact piece 112 goes to ride on the sloped surface 120*a* of the contact portion 120, the ink receiving member 110 is pivoted in the clockwise direction (first pivotal direction) of FIG. 22 and held in the discharge posture (posture of FIG. 22).

Next, the structure of the collection tray 44 will be described in detail.

Figure 24:
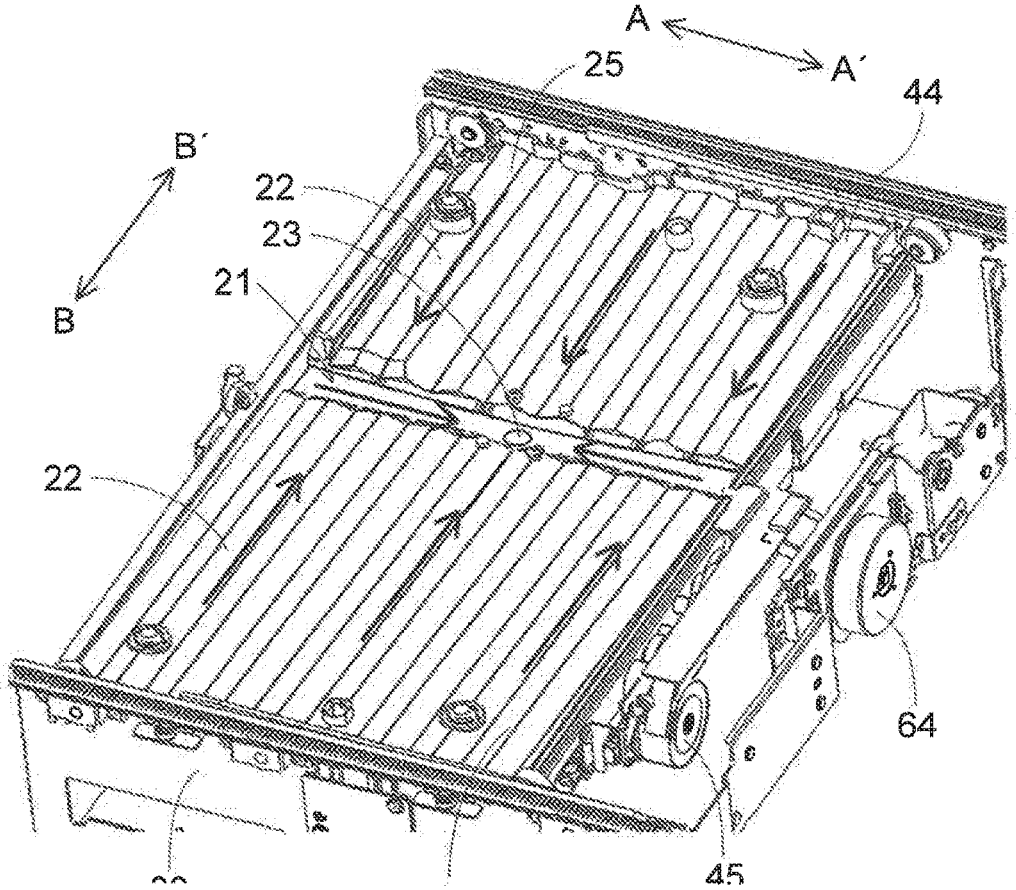
FIG. 24 is a view showing a structure of around the collection tray in the wipe unit according to one embodiment of the disclosure.

As shown in FIG. 17, the collection tray 44, which is placed below the wipers 35*a* to 35*c*, collects ink wiped off by the wipers 35*a* to 35*c*. As shown in FIG. 24, provided in an upper surface of the collection tray 44 are a central groove 21 placed at a central portion in the arrow BB' direction and extending in the arrow AA' direction, and a pair of tray surfaces 22 which are placed on both sides in the arrow BB' direction with the central groove 21 interposed therebetween and which receive ink. The tray surfaces 22 are sloped downward toward the central groove 21. As a result of this, ink having dropped on the tray surfaces 22 flows toward the central groove 21 so as to be collected.

The central groove 21 is so formed as to be sloped downward toward the arrow-AA'-direction central portion. A discharge opening 23 for discharging collect ink downward is provided at an arrow-AA'-direction central portion of the central groove 21. A discharge tube linked to a waste ink tank (both members unshown) is connected to the discharge opening 23. Ink wiped off from the ink ejection surfaces F by the wipers 35*a* to 35*c* and having dropped onto the tray surfaces 22 flows on the tray surfaces 22 toward the central groove 21, further flows within the central groove 21 toward the discharge opening 23, thus being discharged through the discharge opening 23.

On the tray surfaces 22, a plurality of grooves 25 are provided so as to each extend in the arrow BB' direction and have a trough shape in cross section. Ink having dropped onto the tray surfaces 22 flows within the grooves 25 toward the central groove 21.

Next, recovery operation of the recording heads 17*a* to 17*c* in the printer 100 of this embodiment will be described. The recovery operation and the capping operation described below are executed on the basis that operations of the recording heads 17*a* to 17*c*, the wipe unit 19, the unit up/down moving mechanism 60, the unit horizontal moving mechanism 85, the conveyance up/down moving mechanism, various drive sources, and the like are controlled according to control signals derived from the control section 101 (see FIG. 1).

When the recovery process for the recording heads 17*a* to 17*c* is executed by the wipe unit 19, the first conveyance unit 5 placed in opposition to the lower surface of the recording part 9 (see FIG. 1) as shown in FIG. 7 is moved down in the state of FIG. 6. In this case, the wipe unit 19 is set at the first height position, where the wipe unit 19 and the cap unit 50 are not coupled to each other.

Then, as shown in FIG. 11, the carriage 80 is moved horizontally from the second position to the first position with the cap unit 50 left in the second position. By this process, the wipe unit 19 is moved horizontally from the second position to the first position as it is in the first height position.

Then, the wipe unit 19 is moved up by the unit up/down moving mechanism 60 as shown in FIG. 12. As a result of this, the wipers 35*a* to 35*c* of the wipe unit 19 are brought into pressure contact with wiping start positions of the ink ejection surfaces F of the recording heads 17*a* to 17*c*.

Then, prior to the wiping operation, ink is supplied to the recording heads 17*a* to 17*c*. The supplied ink is forcedly pushed out (purge) from the ink ejection ports 18 (see FIG. 2). By this purge operation, thickened ink as well as foreign matters and air bubbles within the ink ejection ports 18 are discharged. In this process, purge ink is pushed out onto the ink ejection surfaces F along the shape of the ink ejection areas R (see FIG. 5) in which the ink ejection ports 18 are provided.

Thereafter, a wiping operation of wiping off ink (purge ink) pushed out onto the ink ejection surfaces F is executed. More specifically, as the wiper carriage moving motor 45 is rotated forward in the state shown in FIG. 12, the wiper carriage 31 is moved horizontally in the arrow B direction as shown in FIG. 13, so that the wipers 35*a* to 35*c* wipe off ink pushed out on the ink ejection surfaces F of the recording heads 17*a* to 17*c*. Waste ink wiped off by the wipers 35*a* is collected to the ink receiving member 110 provided in the wiper carriage 31. The waste ink wiped off by the wipers 35*b* and 35*c* is collected onto the collection tray 44 placed in the wipe unit 19. In this case, waste ink wiped off by the wipers 35*a* to 35*c* passes along wiping-direction downstream-side surfaces (arrow B-side surfaces) of the wipers 35*a* to 35*c* so as to be moved to the wiper fixing member 37. Then, the waste ink drops onto the ink receiving member 110 or the collection tray 44 from the lowermost end 39*b* of the lower end portion (Ink dropping part 39*a*) of the wiper fixing member 37. In addition, in this process, the ink receiving member 110 is held in the storage posture (posture of FIG. 22).

Figure 23:
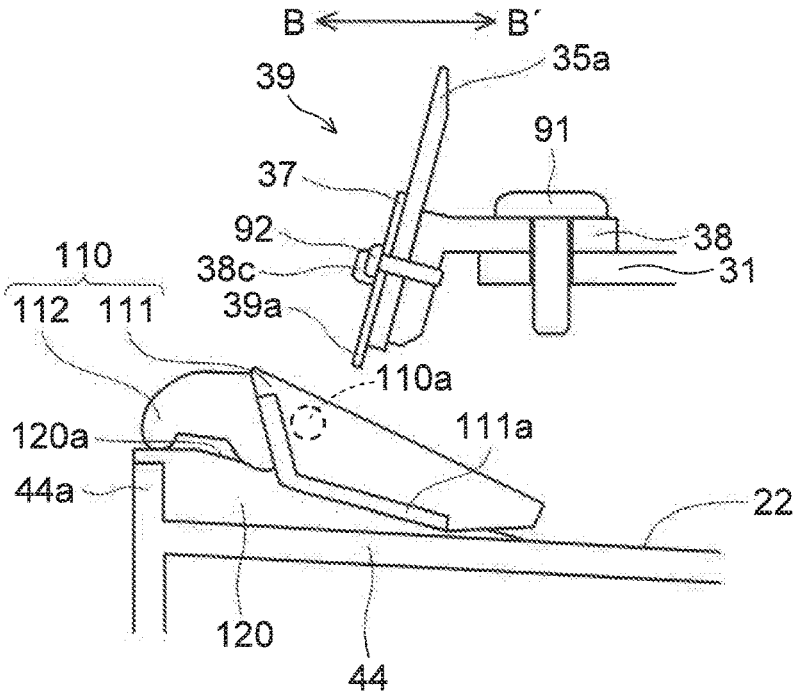
FIG. 23 is a view showing a structure of around the wiper, the ink receiving member, and the collection tray in the wipe unit according to one embodiment of the disclosure, where the ink receiving member is set in a discharge posture.

When the wiper carriage 31 has reached the furthest downstream position in the wiping direction, the contact piece 112 comes into contact with the sloped surface 120*a* of the contact portion 120 as shown in FIG. 23, where the ink receiving member 110 is pivoted clockwise and held in the discharge posture (posture of FIG. 23). As a result of this, the waste ink within the ink receiving member 110 is discharged from wiping-direction upstream-side part (right end portion in FIG. 23) of the ink receiving member 110, thus dropping onto the collection tray 44.

Thereafter, the wipe unit 19 is moved down to the first height position by the unit up/down moving mechanism 60 (see FIG. 14) as shown in FIG. 11, so that the wipers 35*a* to 35*c* are moved downwardly away from the ink ejection surfaces F of the recording heads 17*a* to 17*c*. After that, the wiper carriage 31 is moved in a direction (arrow B' direction) opposite to the wiping direction, thereby restoring the wipe unit 19 to the original state. In this process, the ink receiving member 110 is pivoted counterclockwise as in FIG. 23, thus returned to the storage posture (posture of FIG. 23).

Then, the carriage 80 and the wipe unit 19 placed in the first position are moved horizontally from the first position to the second position. As a result, the wipe unit 19 is placed below the cap unit 50. Thus, the recovery operation for the recording heeds 17*a* to 17*c* is completed.

In addition, ink having dropped onto the tray surfaces 22 of the collection tray 44 flows within the grooves 25 of the tray surfaces 22 toward the central groove 21, thereafter flowing within the central groove 21 toward the discharge opening 23. Then, the ink passes through the discharge tube so as to be stored in the waste ink tank (both members unshown).

Next, an operation (capping operation) of fitting the cap unit 50 to the recording heads 17*a* to 17*c* in the printer 100 of this embodiment will be described.

When capping for the recording heads 17*a* to 17*c* is executed by the cap unit 50, the first conveyance unit 5 placed in opposition to the lower surface of the recording part 9 (see FIG. 1) is moved down from the state of FIG. 6, as shown in FIG. 7. In this process, the wipe unit 19 is set at the first height position, where the wipe unit 19 and the cap unit 50 are not coupled to each other.

Then, the wipe unit 19 is moved up from the first height position to the second height position by the unit up/down moving mechanism 60 (see FIG. 14). As a result, the coupling pins 42 are inserted into the coupling holes 52*a* as shown in FIG. 16, so that the wipe unit 19 and the cap unit 50 are coupled to each other.

Thereafter, the carriage 80 is moved horizontally from the second position to the first position as shown in FIG. 8. As a result of this, the cap unit 50 is moved horizontally from the second position to the first position while remaining coupled to the upper surface of the wipe unit 19.

Then, the wipe unit 19 and the cap unit 50 are moved up by the unit up/down moving mechanism 60 as shown in FIG. 9. At a time when the cap parts 53 of the cap unit 50 are brought into close contact with the ink ejection surfaces F of the recording heads 17*a* to 17*c*, rotation of the take-up driving motor 64 (see FIG. 14) is stopped. Thus, the capping for the recording heads 17*a* to 17*c* of the cap unit 50 is completed.

In this embodiment, as described above, the ink receiving member 110 receives ink dropping from the wipers 35*a* placed furthest wiping-direction downstream among the wipers 35*a* to 35*c*, and moreover lets ink drop onto the tray surfaces 22. As a result of this, when the wiper carriage 31 has reached the furthest wiping-direction downstream position, ink having dropped from the wipers 35*a* can once be received by the ink receiving member 110 and thereafter be let to drop onto the tray surfaces 22 from the ink receiving member 110. That is, a falling distance to which ink drops onto the tray surfaces 22 can be reduced so that resultant shocks can be reduced. Therefore, ink that has dropped onto the tray surfaces 22 can be prevented from flying out of the collection tray 44 beyond the wiping-direction downstream-side side face 44*a* of the collection tray 44. As a result, ink stains inside the printer 100 can be suppressed.

Also as described above, the ink receiving member 110 lets ink drop onto the tray surfaces 22 from a wiping-direction upstream-side part (cutout 111*d*). As a result of this, the position where ink drops onto the tray surfaces 22 can be set farther from the side face 44*a* of the collection tray 44. Therefore, ink that has dropped onto the tray surfaces 22 can be prevented to more extent from flying out of the collection tray 44 beyond the side face 44*a* of the collection tray 44.

Also as described above, the contact portion 120 that is brought into contact with the ink receiving member 110 to make the ink receiving member 110 pivoted from the storage posture to the discharge posture is provided at the wiping-direction downstream end portion of the collection tray 44. As a result of this, the ink receiving member 110 remains in the storage posture until it reaches the wiping-direction downstream end portion of the collection tray 44 (until it comes into contact with the contact portion 120), and turns to the discharge posture upon reaching the wiping-direction downstream end portion of the collection tray 44 (upon coming into contact with the contact portion 120). Therefore, since ink can be flushed away at a stroke after having been stored in the ink receiving member 110, ink can be prevented from being left and solidifying within the ink receiving member 110. In addition, when only a small quantity of ink is present in the ink receiving member 110, ink is less likely to flow even though the ink receiving member 110 comes to the discharge posture, so that ink may solidify in the ink receiving member 110.

Also as described above, the biasing member 115 that biases the ink receiving member 110 in the counterclockwise direction (second pivotal direction) of FIG. 22 is provided in the wiper carriage 31. As a result of this, the ink receiving member 110 can be easily held in the storage posture until it reaches the wiping-direction downstream end portion of the collection tray 44 (until it comes into contact with the contact portion 120).

Also as described above, when the contact piece 112 is moved on the sloped surface 120*a* from upstream side to downstream side in the wiping direction, the ink receiving member 110 is turned from the storage posture to the discharge posture. As a result of this, it becomes easily achievable to change over the ink receiving member 110 from the storage posture to the discharge posture when the ink receiving member 110 has reached the wiping-direction downstream end portion of the collection tray 44.

Also as described above, the arrow-AA'-direction length of the ink receiving member 110 is shorter than the arrow-AA'-direction length of the wiping part 39, and the lowermost end 39*b* of the ink dropping part 39*a* is placed at a position just above the ink receiving member 110. As a result of this, ink dropping from the ink dropping part 39*a* can be securely received by the ink receiving member 110 while the ink receiving member 110 is downsized in the arrow AA' direction.

The embodiment disclosed herein should be construed as not being limitative but being an exemplification at all points. The scope of the disclosure is defined not by the above description of the embodiment but by the appended claims, including all changes and modifications equivalent in sense and range to the claims.

Figure 25:
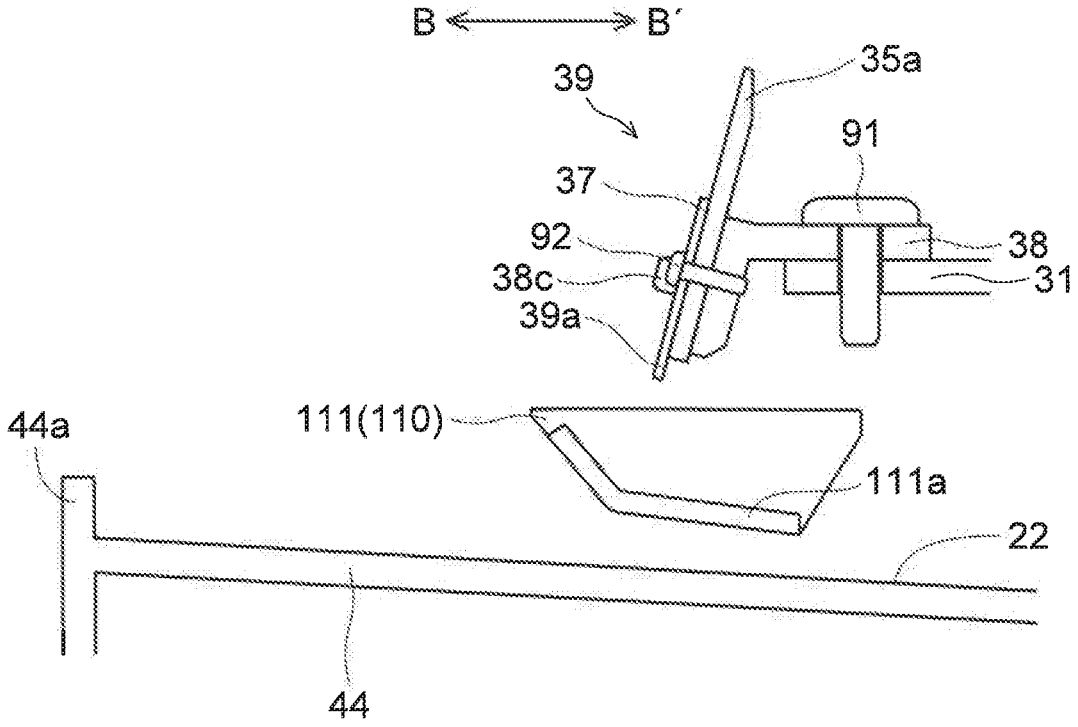
FIG. 25 is a view showing a structure of around the ink receiving member in a wipe unit according to a modification of the disclosure.

For example, whereas the above embodiment has been exemplified by a case in which the posture of the ink receiving member 110 is changed over between storage posture and discharge posture, the present disclosure is not limited to this. Like a wipe unit 19 which is a modification of the disclosure shown in FIG. 25, as an example, the ink receiving member 110, without providing the pivoting shaft 110*a* therein, may be constituted unchangeable in posture. In this case, preferably, the sloped bottom surface 111*a* of the ink receiving member 110 is sloped downward toward the wiping-direction upstream side so as to let ink drop onto the tray surfaces 22 from wiping-direction upstream side part.

Also, the above embodiment has been described on a case in which the grooves 25 having a trough shape in cross section are formed on the tray surfaces 22. However, the disclosure is not limited to this, and it is allowable that no grooves 25 are formed on the tray surfaces 22.

Also, the above embodiment has been described on a case in which the lower end portion of the wiper fixing member 37 serves as the ink dropping part 39*a*. However, the disclosure is not limited to this. For example, the wipers 35*a* to 35*c* may be formed so as to extend even lower than the lower end of the wiper fixing member 37, where lower end portions of the wipers 35*a* to 35*c* may be assigned to ink dropping parts 39*a*. In this case, ink wiped off by the wipers 35*a* to 35*c* is moved along the wipers 35*a* to 35*c* to the wiper fixing member 37, and further moved along the wiper fixing member 37 to the wipers 35*a* to 35*c*, thus dropping from the lower end portions (ink dropping parts 39*a*) of the wipers 35*a* to 35*c*. Furthermore, the holding portion 38*b* of the fixation auxiliary member 38 may be formed longer in length, with the lower end portion of the holding portion 38*b* assigned to the ink dropping part 39*a*.

What is claimed is:

1. A wipe unit for cleaning a recording head having an ink ejection surface in which an ink ejection port for ejecting ink onto a recording medium is opened, comprising:

one or more wipers which are brought into contact with the ink ejection surface;

a wiper carriage which is moved along a wiping direction while the wiper is in contact with the ink ejection surface;

a collection tray placed below the wiper and having a tray surface for collecting the ink wiped off by the wiper;

a recessed-shaped ink receiving member which is provided in the wiper carriage and which receives the ink dropping from a wiper that is placed furthest downstream in the wiping direction among the one or more wipers and moreover which lets the ink drop onto the tray surface; and a contact portion which is provided at a wiping-direction downstream end portion of the collection tray, wherein the ink receiving member lets the ink drop from a wiping-direction upstream-side part onto the tray surface, the ink receiving member, which is provided so as to be pivotable about a pivoting shaft extending in a direction perpendicular to the wiping direction, is placed selectively either in a storage posture in which the ink is stored or in a discharge posture in which the ink is discharged to the tray surface by the ink receiving member being pivoted from the storage posture in such a first pivotal direction that a wiping-direction upstream end of the ink receiving member approaches the tray surface, and the contact portion is brought into contact with the ink receiving member to make the ink receiving member pivoted from the storage posture to the discharge posture.

2. The wipe unit according to claim 1, wherein the wiper carriage is equipped with a biasing member for biasing the ink receiving member in a second pivotal direction opposite to the first pivotal direction.

3. The wipe unit according to claim 1, wherein the contact portion has a sloped surface sloped upward toward a downstream side in the wiping direction, the ink receiving member includes a contact piece which is to be brought into contact with the sloped surface, and as the contact piece is moved on the sloped surface from upstream side to downstream side in the wiping direction, the ink receiving member is changed over in posture from the storage posture to the discharge posture.

4. The wipe unit according to claim 1, further comprising a wiper fixing member for fixing the wiper to the wiper carriage, wherein the wiper and the wiper fixing member constitute a wiping part, the wiping part includes an ink dropping part for dropping the ink wiped off by the wiper, the ink dropping part is so formed that its length in a widthwise direction perpendicular to the wiping direction becomes shorter and shorter as viewed in a downward direction, a length of the ink receiving member in the widthwise direction is shorter than a length of the wiping part in the widthwise direction, and a lowermost end of the ink dropping part is placed just above the ink receiving member.

5. An ink jet recording apparatus comprising:

the wipe unit according to claim 1; and the recording head for ejecting the ink onto the recording medium.

6. A wipe unit for cleaning a recording head having an ink ejection surface in which an ink ejection port for ejecting ink onto a recording medium is opened, comprising:

one or more wipers which are brought into contact with the ink ejection surface;

a wiper carriage which is moved along a wiping direction while the wiper is in contact with the ink ejection surface;

a collection tray placed below the wiper and having a tray surface for collecting the ink wiped off by the wiper;

a recessed-shaped ink receiving member which is provided in the wiper carriage and which receives the ink dropping from a wiper that is placed furthest downstream in the wiping direction among the one or more wipers and moreover which lets the ink drop onto the tray surface; and a contact portion which is provided on a downstream side of the ink receiving member in the wiping direction, wherein the ink receiving member lets the ink drop from a wiping-direction upstream-side part onto the tray surface, the ink receiving member, which is provided so as to be pivotable about a pivoting shaft extending in a direction perpendicular to the wiping direction, is placed selectively either in a storage posture in which the ink is stored or in a discharge posture in which the ink is discharged to the tray surface by the ink receiving member being pivoted from the storage posture in such a first pivotal direction that a wiping-direction upstream end of the ink receiving member approaches the tray surface, and the contact portion is brought into contact with the ink receiving member to make the ink receiving member pivoted from the storage posture to the discharge posture.

7. An ink jet recording apparatus comprising:

the wipe unit according to claim 6; and the recording head for ejecting the ink onto the recording medium.

* * * * *